US006840227B2

(12) United States Patent
Reiter et al.

(10) Patent No.: US 6,840,227 B2
(45) Date of Patent: Jan. 11, 2005

(54) FASTENING DEVICE FOR A FUEL INJECTION VALVE

(75) Inventors: Ferdinand Reiter, Markgroeningen (DE); Jens Pohlmann, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/276,868

(22) PCT Filed: Mar. 15, 2002

(86) PCT No.: PCT/DE02/00954

§ 371 (c)(1),
(2), (4) Date: Jun. 16, 2003

(87) PCT Pub. No.: WO02/075147

PCT Pub. Date: Sep. 26, 2002

(65) Prior Publication Data

US 2004/0020469 A1 Feb. 5, 2004

(30) Foreign Application Priority Data

Mar. 16, 2001 (DE) ..... 101 12 665

(51) Int. Cl.[7] ..... F02M 55/00
(52) U.S. Cl. ..... 123/470
(58) Field of Search ..... 123/470

(56) References Cited

U.S. PATENT DOCUMENTS

| | | | | | |
|---|---|---|---|---|---|
| 5,566,658 | A | * | 10/1996 | Edwards et al. | 123/470 |
| 5,697,345 | A | * | 12/1997 | Genter et al. | 123/470 |
| 6,116,218 | A | * | 9/2000 | Sato et al. | 123/470 |
| 6,318,341 | B1 | * | 11/2001 | Gmelin et al. | 123/470 |
| 6,532,939 | B2 | * | 3/2003 | Ozeki | 123/470 |

FOREIGN PATENT DOCUMENTS

| | | |
|---|---|---|
| DE | 19735665 | 1/1999 |
| JP | 57070952 | 5/1982 |
| JP | 04171267 | 6/1992 |
| JP | 06235366 | 8/1994 |
| JP | 08312503 | 11/1996 |
| JP | 11082241 | 3/1999 |

* cited by examiner

*Primary Examiner*—Thomas Moulis
(74) *Attorney, Agent, or Firm*—Kenyon & Kenyon

(57) ABSTRACT

A mounting device for mounting a fuel injector in a cylinder head for direct injection of fuel into the combustion chamber of an internal combustion engine, including a holding down device which is attached to the fuel injector, the holding down device being designed as a flat component which is supported by a sleeve which surrounds the fuel injector, and rests on a preferably metallic flange of the fuel injector.

13 Claims, 2 Drawing Sheets

FASTENING DEVICE FOR A FUEL INJECTION VALVE

FIELD OF THE INVENTION

The present invention is directed to a mounting device for mounting a fuel injector in a cylinder head of an internal combustion engine.

BACKGROUND INFORMATION

Fuel injectors for direct injection of fuel into the combustion chamber of a mixture-compressing, spark-ignited internal combustion engine are commonly held down in the cylinder head by a clamping claw which is bolted to the cylinder head of the engine. Such a clamping daw is described in Japanese Patent Application No. 08-31 25 03. The clamping claw presses on a shoulder of the fuel injector, thereby securing it in the location hole of the cylinder head. By using an appropriate tool, i.e., a dynamometric wrench, the clamping claw is tightened to an extent that the fuel injector cannot be pushed out of the cylinder head by the pressure prevailing in the combustion chamber of the engine.

In particular, the stressing effect of the clamping claw on the fuel injector is a disadvantage in known mounting devices. The flow of force created in the fuel injector results in deformations and thus to lift changes of the valve needle including jamming, as well as a compression and bending strain on the housing parts which are generally thin-walled and welded together at several points. In addition, each mounting operation, through a support shoulder for example, results in an enlargement of the radial dimension of the fuel injector and thus in an increase in the space required for mounting.

SUMMARY OF THE INVENTION

The mounting device for a fuel injector according to the present invention has the advantage over the related art that the fuel injector is pressed down by a holding down device situated between the fuel injector and a mounting element and thus no stresses occur due to excessively high bolting forces. Force is introduced into the fuel injector solely axially without a radial component. However, the holding down force may be adjusted in such a way that the fuel injector is held securely in the cylinder head.

It is a particular advantage that two asymmetrical trunnions of the sleeve of the fuel injector snap into two recesses of the holding down device, thus preventing the injector from twisting and ensuring that the holding down device is always mounted in the proper position.

The sleeve and the holding down device are advantageously manufactured from spring steel sheet by stamping, thereby showing good elasticity properties.

It is a further advantage that the mounting element may be secured to the cylinder head in a simple manner by using a bolt.

DETAILED DESCRIPTION

Figure 1:
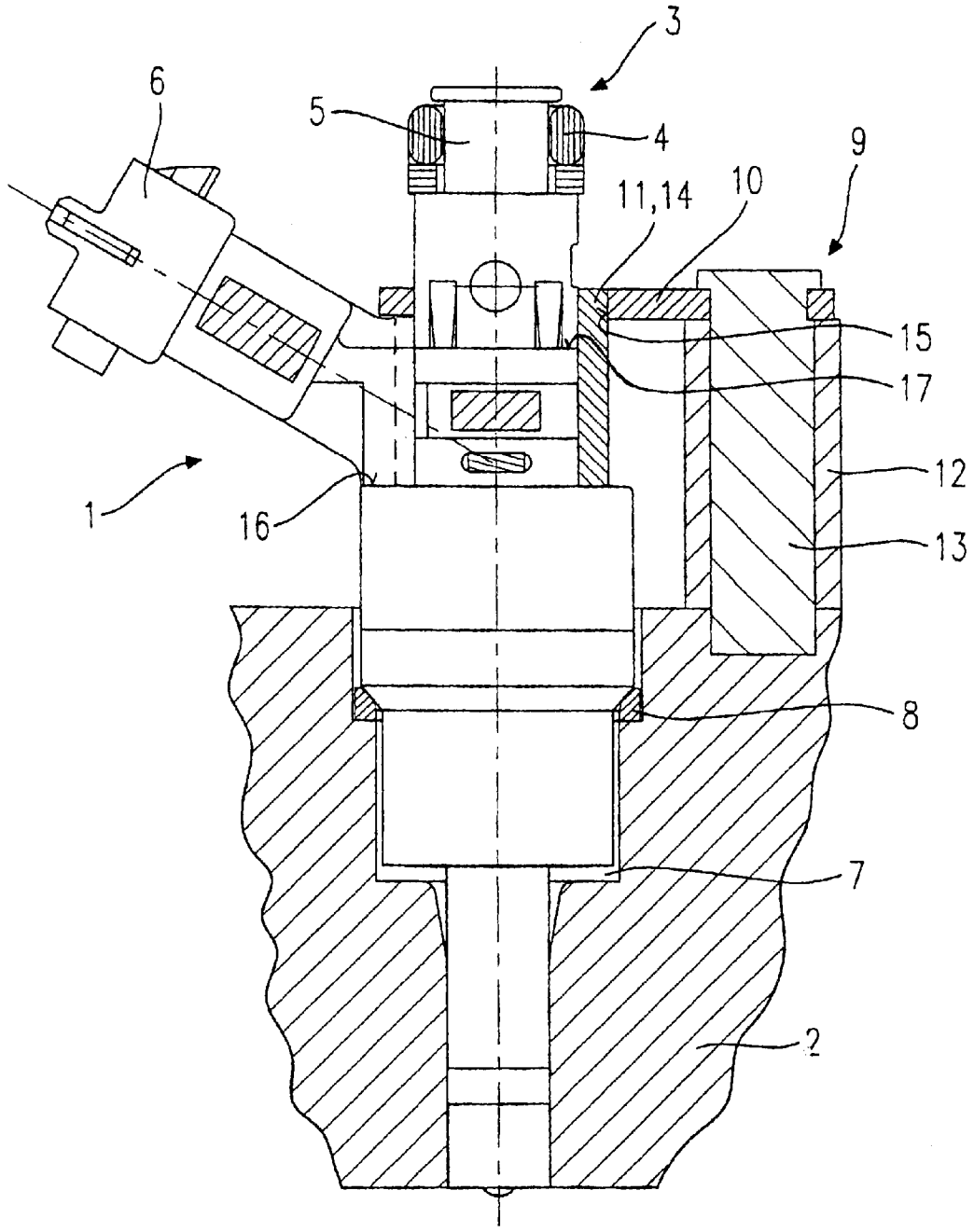
FIG. 1 shows a schematic partial section through an exemplary embodiment of a mounting device for a fuel injector according to the present invention.

FIG. 1 shows a schematic and simplified view of an exemplary embodiment of a mounting device for a fuel injector on a cylinder head of an internal combustion engine, designed according to the present invention, where, for the sake of clarity, mounting device 9 and fuel injector 1, viewed in the perimeter direction, are not illustrated in their exact relative positions.

Fuel injector 1 is designed here in the form of a direct injecting fuel injector 1, which is mounted in a cylinder head 2 for direct injection of fuel into a combustion chamber of a mixture-compressing, spark-ignited engine (not shown). At its upstream end 3, fuel injector 1 has a plug-in connection to a fuel distribution line (not shown) which is sealed by a gasket 4 situated between the fuel distribution line and a feed line connection 5 of fuel injector 1. Fuel injector 1 has an electrical terminal 6 for the electrical contact for actuation of fuel injector 1.

Fuel injector 1 has an intermediate ring 8 situated in a location hole 7 of cylinder head 2 and used as a support for fuel injector 1 in location hole 7. Intermediate ring 8 is made of an elastic material and provides for centering of fuel injector 1 in location hole 7.

In order to secure fuel injector 1 in location hole 7 of cylinder head 2, a mounting device 9 is provided according to the present invention. Mounting device 9 is composed of a holding down device 10 which is supported both by a sleeve 11, which is attached to upstream end 3 of fuel injector 1 and rests on a metal shoulder 16 of fuel injector 1, and by a mounting element 12 which is fastened to cylinder head 2 by a bolt 13 extending through the mounting element. The axial length of the part of fuel injector 1 protruding over cylinder head 2 and the axial length of mounting element 12 are roughly the same.

Sleeve 11 is preferably stamped out of spring steel sheet and has two trunnions 14 in the exemplary embodiment which secure holding down device 10 to sleeve 11. Because trunnions 14 snap into appropriate recesses 15 of holding down device 10, they prevent lateral torsion of holding down device 10 and they serve as a precaution against shearing forces between fuel injector 1 and mounting device 9. Sleeve 11 is slitted in the area of electrical terminal 6 and thus interrupted over 90° for example. The manufacture from spring steel ensures the positive fit of sleeve 11 on fuel injector 1. In the exemplary embodiment, sleeve 11 is supported by metal shoulder 16 of fuel injector 1; the sleeve may however also be supported by a plastic shoulder 17 of fuel injector 1, positioned further upstream, for example.

Figure 2:
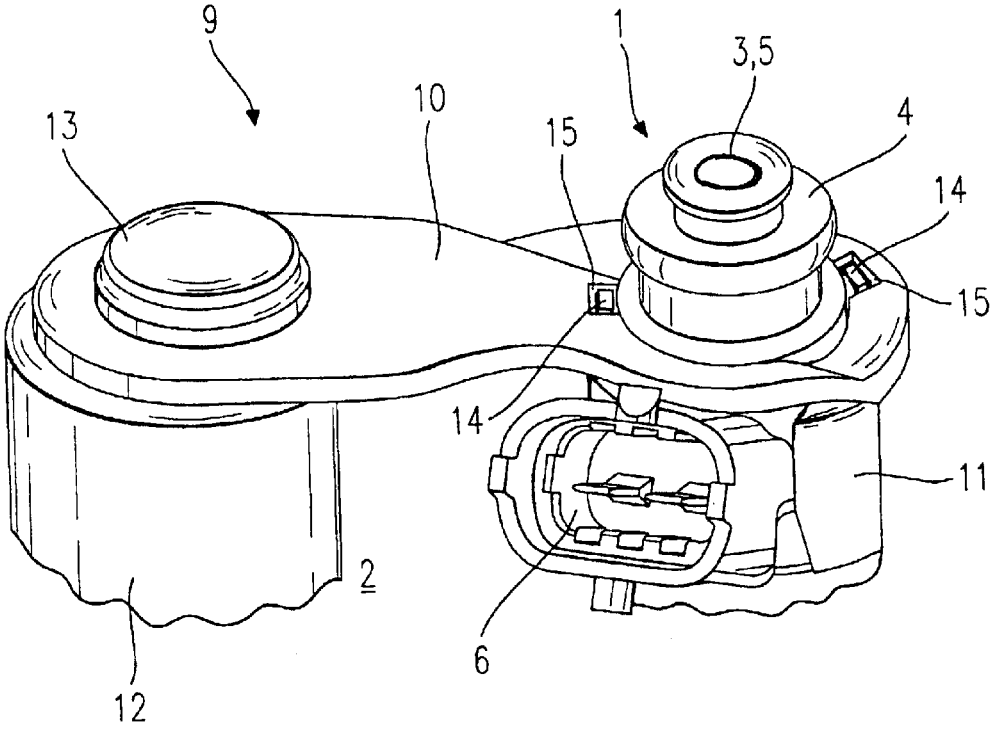
FIG. 2 shows a schematic view of a fuel injector secured in the cylinder head of an internal combustion engine by a mounting device designed according to the present invention illustrated in FIG. 1.

Trunnions 14 of sleeve 11 may be situated asymmetrically on the perimeter of sleeve 11, so that the mounting position of holding down device 10 is clearly defined. The purpose of this measure is apparent from the perspective illustration of mounting device 10 in FIG. 2. Since holding down device 10 is designed asymmetrically for the prevention of shearing forces, accurate mounting in the proper position must be ensured, the part of holding down device 10, supported by mounting element 12, being partially bent up opposite the area resting on sleeve 11. Accurate mounting may be achieved by the asymmetrical positioning of trunnions 14 on sleeve 11, i.e., corresponding recesses 15 of holding down device 10.

Mounting device 9 may be secured on cylinder head 2, as illustrated in the exemplary embodiment, for example, by using bolt 13 which extends through mounting element 12 and is screwed into cylinder head 2. Bolt 13 is used at the same time for securing holding down device 10 to mounting element 12. There are other mounting methods, for example, by pressing in a bolt into an undercut volume of a recess in cylinder head 2 and subsequent mounting of holding down device 10 using a short screw.

Different aspects of mounting may be improved by the bent shape of flat holding down device 10 and the introduction of the force of mounting device 9 via sleeve 11 into fuel injector 1. Due to the flexibility of holding down device 10, which causes an elastic, as well as a partial plastic deformability of holding down device 10, the danger of damage to fuel injector 1 due to excessive pressure when an excessive tightening torque is applied during installation of mounting device 9 no longer exists and the tension of holding down device 10 with suitable selection of the material, as well as of the distance to mounting element 12 is still sufficiently high to press fuel injector 1 into cylinder head 2 against the pressure in the combustion chamber of the engine.

Also axial offsets, which may occur due to manufacturing tolerances of the individual components of fuel injector 1, as well as due to uneven heating during operation of the engine, are compensatable with no problem. Holding down device 10 and mounting element 12 are easy to manufacture and are easily secured to cylinder head 2 by using bolt 13. The tightening torque during installation no longer has to assume a definite value, but may vary in a certain range without creating malfunctions due to excessive or too weak tightening of bolt 13.

The present invention is not limited to the illustrated exemplary embodiment and is, for example, also applicable for fuel injectors 1 for injection into the combustion chamber of a self-igniting internal combustion engine.

What is claimed is:

1. A mounting device for mounting a fuel injector for direct injection of fuel into a combustion chamber of an internal combustion engine, on a cylinder head of the engine, the fuel injector including a flange, the mounting device comprising:

a sleeve surrounding the fuel injector and resting on the flange; and a holding down device mounted on the fuel injector, the holding down device including a flat component supported by the sleeve;

wherein the sleeve has trunnions pointing in the direction of an inflow-side end of the fuel injector.

2. The mounting device according to claim 1, wherein the flange is a metallic flange.

3. The mounting device according to claim 1, further comprising a mounting element supporting the holding down device and a bolt securing the mounting element to the cylinder head.

4. The mounting device according to claim 1, wherein the trunnions are snappable into recesses of the holding down device.

5. The mounting device according to claim 4, wherein the trunnions and the recesses are situated asymmetrically with respect to a perimeter of the sleeve.

6. A mounting device for mounting a fuel injector for direct injection of fuel into a combustion chamber of an internal combustion engine, on a cylinder head of the engine, the fuel injector including a flange, the mounting device comprising:

a sleeve surrounding the fuel injector and resting on the flange;

a holding down device mounted on the fuel injector, the holding down device including a flat component supported by the sleeve; and a mounting element supporting the holding down device and a bolt securing the mounting element to the cylinder head;

wherein the mounting element is in the shape of a sleeve.

7. The mounting device according to claim 6, further comprising a bolt extending through the mounting element.

8. A mounting device for mounting a fuel injector for direct injection of fuel into a combustion chamber of an internal combustion engine, on a cylinder head of the engine, the fuel injector including a flange, the mounting device comprising:

a sleeve surrounding the fuel injector and resting on the flange; and a holding down device mounted on the fuel injector, the holding down device including a flat component supported by the sleeve;

wherein the sleeve is interrupted in an area of an electrical terminal of the fuel injector.

9. A mounting device for mounting a fuel injector for direct injection of fuel into a combustion chamber of an internal combustion engine, on a cylinder head of the engine, the fuel injector including a flange, the mounting device comprising:

a sleeve surrounding the fuel injector and resting on the flange;

a holding down device mounted on the fuel injector, the holding down device including a flat component supported by the sleeve; and a mounting element supporting the holding down device and a bolt securing the mounting element to the cylinder head;

wherein the holding down device is bent in an undulated shape, so that a first support surface of the holding down device on the mounting element lies on a different level than a second support surface of the holding down device on the sleeve of the fuel injector.

10. The mounting device according to claim 6, wherein the flange is a metallic flange.

11. The mounting device according to claim 8, wherein the flange is a metallic flange.

12. The mounting device according to claim 8, further comprising a mounting element supporting the holding down device and a bolt securing the mounting element to the cylinder head.

13. The mounting device according to claim 9, wherein the flange is a metallic flange.

* * * * *

UNITED STATES PATENT AND TRADEMARK OFFICE

CERTIFICATE OF CORRECTION

PATENT NO. : 6,840,227 B2
DATED : January 11, 2005
INVENTOR(S) : Reiter et al.

It is certified that error appears in the above-identified patent and that said Letters Patent is hereby corrected as shown below:

Column 1,
Line 16, change "Such a clamping daw" to -- Such a clamping claw --

Signed and Sealed this

Twelfth Day of July, 2005

JON W. DUDAS
*Director of the United States Patent and Trademark Office*